US005732854A

United States Patent [19]

Ruben et al.

[11] Patent Number: 5,732,854

[45] Date of Patent: Mar. 31, 1998

[54] DEVICE, METHOD, AND SYSTEM FOR CONTROLLING VOLUME OF COLLAPSIBLE SQUEEZE TUBES, AND METHODS OF MAKING AND USING THE SAME

[76] Inventors: Robert M. Ruben, 454-229 Prospect Ave., West Orange, N.J. 07052; Bradley N. Ruben, 463 First St., Apt. 5A, Hoboken, N.J. 07030

[21] Appl. No.: 528,141

[22] Filed: Sep. 14, 1995

Related U.S. Application Data

[63] Continuation-in-part of Ser. No. 208,441, Mar. 9, 1994, abandoned.

[51] Int. Cl.[6] ..... B65D 35/32

[52] U.S. Cl. ..... 222/99; 222/100; 222/105; 222/183

[58] Field of Search ..... 222/92, 99, 100, 222/105, 107, 183

[56] References Cited

U.S. PATENT DOCUMENTS

| | | | |
|---|---|---|---|
| 3,160,323 | 12/1964 | Weisberg | 222/107 |
| 3,211,342 | 10/1965 | De Wayne Miles | 222/107 |
| 3,746,215 | 7/1973 | Ausnit et al. | 222/92 |
| 3,868,036 | 2/1975 | Wittwer | 222/105 |
| 4,090,514 | 5/1978 | Hinck et al. | 222/105 |
| 4,807,782 | 2/1989 | Meinerding et al. | 222/107 X |
| 5,108,008 | 4/1992 | Ryder | 222/99 |
| 5,330,077 | 7/1994 | Swanson | 222/105 X |
| 5,344,049 | 9/1994 | MacDonald | 222/99 X |
| 5,361,939 | 11/1994 | Robertson, Jr. | 222/92 X |
| 5,373,968 | 12/1994 | Nelson | 222/99 |
| 5,467,897 | 11/1995 | Williams | 222/107 |

FOREIGN PATENT DOCUMENTS

| | | | |
|---|---|---|---|
| 1074166 | 2/1954 | France . | |
| 1325078 | 5/1963 | France . | |
| 9008072 | 7/1990 | WIPO | 222/99 |

*Primary Examiner*—Joseph Kaufman
*Attorney, Agent, or Firm*—Bradley N. Ruben

[57] ABSTRACT

The invention provides a novel squeezable dispensing container, a sleeve for conventional squeezable dispensing containers, and a tab strip that can be used to convert conventional squeeze tubes into those of the present invention, that can be secured in an at least partially rolled up configuration after at least a portion of the contents of the container have been extruded.

15 Claims, 4 Drawing Sheets

131
137
141
135
143

137
146
145

101
133a
131
133b 101
127
107
129

105
113
111
109
127
101
107
161
103

DEVICE, METHOD, AND SYSTEM FOR CONTROLLING VOLUME OF COLLAPSIBLE SQUEEZE TUBES, AND METHODS OF MAKING AND USING THE SAME

This application is a continuation-in-part of application Ser. No. 208,441, filed Mar. 9th, 1994, now abandoned, the disclosure of which is incorporated herein by reference.

BACKGROUND OF THE INVENTION

1. The Field of the Invention

The present invention relates to collapsible tubes used for dispensing creams, pastes, and the like, and to devices therefor, that facilitate controlling the volume of the tube as its contents are being emptied.

2. The State of the Art

Squeeze tube dispensing containers, also call collapsible tubes, are used for dispensing a wide variety of consumer and specialized products, such as toothpaste, paint, caulking and other sealing compounds, glues and other adhesives, greases and other lubricants, shampoo and other toiletry and cosmetic products, cosmetic and pharmaceutical creams, ointments, and gels, and even some condiments and other foodstuffs such as mustard, catsup, processed cheese spreads, icings, and the like. Generally, squeeze tubes are made from a tube of flexible material cut to a particular length. One end of the tube is sealed in a seam, the tube is filled with the particular material to be dispensed, and a sealable dispenser is provided to seal the end of the tube opposite the seam.

In use, the dispenser is opened and the tube is squeezed to extrude the contents out via the dispenser. As material is extruded from the container, the free volume within the tube increases, so that it becomes more difficult when squeezing the tube to direct the material to the dispensing end rather than to some free volume in the tube. The commonplace solution to this problem is to roll up the tube from the sealed portion to effectively minimize the free volume and maintain the contents adjacent to the dispensing end of the tube. However, some materials from which squeeze tubes are commonly made are of flexible but rather unpliable materials, so they will not remained in a rolled up arrangement. Other squeeze tubes are made with materials which are sufficiently pliable that squeezing on the tube in a rolled up condition will provide sufficient internal pressure to unroll the tube and allow the material to flow into the newly created free volume rather than towards the dispensing end. Another solution which has been attempted is the use of a key having a slot into which the sealed end of the tube is placed as a tongue to facilitate rolling the tube, much as keys used for opening sardine cans. Again, however, such devices do not provide any means for retaining the tube in a rolled up condition, and after use it is sometimes difficult to remove the key.

Various methods have been patented which includes mechanically engaging portions on the interior of the tube, such as Chenin and Janodet, in FR 1,074,166, Augros, in FR 1,325,078, and Weisberg, in U.S. Pat. No. 3,160,323. The disadvantages of using mechanically engagable fasteners on the interior of the tube include the inability to positively align the mechanically engaging parts, as well as the problem that the parts will become clogged, and engagement impeded, due to the material present in the tube. Mother solution was proposed by Miles, in U.S. Pat. No. 3,211,342, that includes non-tacky contact adhesive tracks laid longitudinally along opposing sides of the tube. Although adhesive might hold in some environments, in many environments, such as the bathroom, the adhesive is nevertheless likely to become contaminated and not hold well. Further, because the force applied to hold the tube at least partially rolled up is along the longitudinal axis and does not traverse the circumference, it is likely that a significant portion of the material in the tube will leak back into the rolled up portion, and so defeat the attempted solution.

SUMMARY OF THE INVENTION

In view of the foregoing, one of the objects of this invention is to facilitate dispensing a material from a squeeze tube container.

Another object of this invention is to facilitate securing a squeeze tube container in an at least partially rolled up geometry.

Still another object of this invention is to provide a device in the form of a squeeze tube that achieves the foregoing objects.

Yet another object of this invention is to provide a device that can be used to modify a conventional squeeze tube to essentially provide the novel squeeze tube of this invention that achieve the aforementioned objects.

Yet still another object of this invention is to provide a sleeve for a conventional squeeze tube that achieves the aforementioned objects of this invention.

Still a further object of this invention is to provide the user of a squeeze tube with an improved method for estimating the remaining contents of a squeeze tube by using the present invention to maintain the tube in a rolled-up configuration that permits more accurate visual inspection of the remaining contents of the tube.

These and other objects will become apparent upon a perusal of this specification.

In one embodiment, this invention provides a dispensing container, comprising a tubular housing having a sealed end, a dispensing end, an outer surface, and an inner volume, the housing adapted for extrusion of a material therein by squeezing and adapted to be rolled up at least partially, and tab means, attached to the outer surface and extending therefrom and effective to traverse the same, comprising mechanically engagable fasteners for securing the housing in an at least partially rolled up geometry.

In another embodiment, this invention provides a sleeve, comprising, a squeezable tubular housing having an outer surface, a sealed end, and an open end, said open end adapted to receive into an interior of the housing a filled squeezable tubular dispensing container adapted for extrusion of a material therein by squeezing; means for releasably retaining the container in the housing; and means on said outer surface comprising mechanically engagable fasteners for securing said housing in an at least partially rolled up geometry with the container received therein.

In yet another embodiment, this invention provides a tab strip having two ends, a longitudinal extent effective both to traverse the circumference of an associated squeeze tube having a sealed end and a dispensing end and for said ends to overlap, opposing surfaces each having mechanically engagable fasteners for engaging each other, and means for attaching said tab strip to the sealed end of the squeeze tube, whereby when said tab strip is attached to said squeeze tube and said ends are overlapped around the circumference thereof and engages, said tab strip maintains said tube in an at least partially rolled up geometry.

DETAILED DESCRIPTION OF PARTICULAR EMBODIMENTS

This invention is particularly applicable to containers from which the contents can be dispensed or extruded by squeezing the container and the unused contents remain stored in the container. Such devices, with reference to FIG. 1, typically include a container 101 having a generally tubular geometry, one end of the tube (tubular housing) of which is closed to provide a sealed end 103, and the other end of the tube is adapted to provide a dispensing end 105. The sealed end is generally provided by crimping and sealing the tube along a linear seam 107 generally orthogonal to the axis of the tube. In other devices, the tube may be first formed from a long sheet of material which is rolled lengthwise and sealed to provide a tube having a longitudinal seal. The tube may be constructed from a unitary material extruded or blown into a tube or a parison or from a single or multilayer sheet rolled into a tube. Depending upon the contents of the tube, it may be desirable to provide a tube comprising one or more layers of materials to provide sealing or barrier properties (e.g., oxidation resistance, puncture resistance, chemical resistance, and the like). In such devices the inner and outer layers are sealed at seam along the longitudinal direction at their overlap. The artisan practicing in these types of packaging arts will realize that inner layer of the tube in contact with the contents of the container should be sufficiently compatible with the contents to avoid contamination or degradation of the contents or degradation of the container. Additionally, the materials of the tube should be chosen to facilitate sealing of the tube, which may be by means of adhesive materials, and is preferably accomplished by heat-sealing with polymeric materials and by processes well-known and commonly practiced to provide a good seal at the seam.

Figures 1, 2, 3, 4, 5:
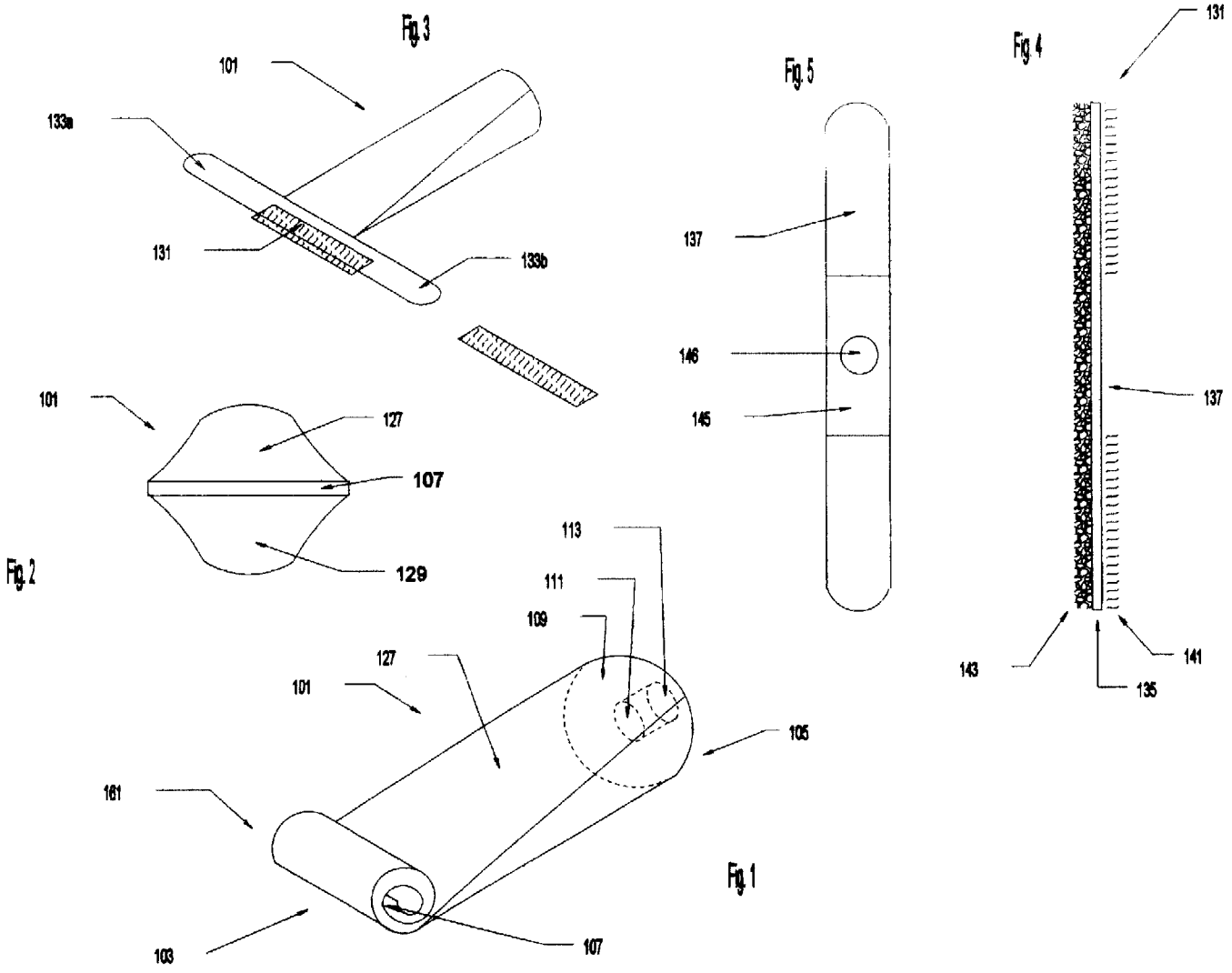
FIG. 1 depicts a perspective view of a squeezable tubular container partially rolled up.
FIG. 2 depicts a rear view of a filled squeezable tubular container.
FIG. 3 depicts a perspective view of an idealized container according to the invention.
FIGS. 4 and 5 depict, respectively, a side view and a front view of a tab strip according to the present invention.

The container shown in FIG. 1 would typically include a dispensing means having a flange 109 sealed to the tube and having port 111 through which the contents of the container can be extruded. The dispensing means preferably also comprises a spout 113 so that the extruded material can be directed or applied in a particular direction by the user. Also preferably, the spout is selectively sealable, such as being provided with threads along its outer surface that are adapted to engage corresponding threads in an associated cap by screwing; other means for selectively sealing the spout, such as snap-top caps, are well-known in the art.

The tube is filled after one end is sealed, and either before or after the dispensing means is affixed.

When the container is first supplied to a user, the inner volume of the tube is typically filled entirely with the desired material purchased by the user. In situations where the entire contents is not used in one instance, the container is typically sealed and stored for later use. Each time the contents is dispensed and the container resealed, free inner volume is created in the tube, that is, a virtual volume that is not filled with the contents. Typically, the user will roll up the tube as shown in FIG. 1, whereupon a first surface 127 is rolled over upon a second surface 129 of the tube. Although the tube would originally have had a generally circular or elliptical cross-section, the linear axis of the seam at the sealed end provides a linear axis about which the tube can be rolled, effective providing the said first and second surfaces as essentially planar surfaces which can be rolled onto each other when the contents have been emptied from that portion of the tube. Unfortunately, as mentioned above, squeezing on the tube in this geometry tends to force the contents both towards the dispensing end and the sealed end, and contents pressing against the sealed end tends to unroll the rolled up portion of the tube and occupy the free volume therein.

According to the present invention, securing means is provided on the outer surface of the container to retain the container in a rolled or partially rolled up geometry. Starting with FIG. 2, depicted is a rear view of a filled squeeze tube container 101 where the seam 107 effectively defines the opposing surfaces 127 and 129 which are rolled on to each other. With reference to FIG. 3, the invention provides a tab 131 attached to and extending from the container 101 and having an extent between its two ends **133*a* and 133*b*** effective to traverse the container. Attachment of the tab is preferably at the seam. The tab can be attached to the container by gluing, such as by sealing with hot glue or thermoplastic when the seam of the container is created; for example, the tab can have a small tongue in its middle and transverse thereto extending into the tube and sealed therein when the seam is made.

The tab is preferably constructed of a material which is sufficiently pliant to be manipulated by the user and having a stiffness that is effective in resisting the force of the contained material forced towards the rolled up portion of the tube when the container is squeezed, thereby maintaining the container is a rolled up geometry. The tabs can be made of a pliant metal, especially for small tubes for pharmaceutical ointments and oil-based paints. For such tubes and for conventional toothpaste tubes (constructed of coated metal), the tab can be formed of the same metal substrate of which the tube is formed. In most embodiments, and especially for collapsible tubes that are resilient (i.e., spring back to their original shape after being squeezed), it will be preferred to provide a tab having a pliant substrate, such as a flexible thermoplastic or a fabric (e.g., nylon, polyester) having integral therewith means for the two ends of the tab to mechanically engage each other. FIG. 4 depicts an idealized side view of an embodiment of the tab (not attached to a squeeze tube container) including a substrate 135, such as the aforementioned fabric, having a first side 137 and a second side. Mechanical hook and loop fasteners (e.g., VELCRO brand) can be attached (glued or sewn) to the first and second sides. As shown for the embodiment in FIG. 4, the first side includes hook-type mechanical fasteners 141 on the first side and loop-type associated fasteners 143 on the opposing side; the space in the middle of on the first side, where the hooks are shown to be missing, is where the tab is attached to the container.

One technique to facilitate packaging and attachment of the tab is to provide a separate tab and have the user attach it, which avoids the additional manufacturing engineering and operation of attaching the tab. A device and method for accomplishing this technique is shown in FIG. 5, an idealized front view of the tab shown in FIG. 4. In FIG. 5, the middle area of the first side 137 is coated with an activatable or protected permanent adhesive effective to provide adequate bonding of the tab to the container in the area 145. This permanent adhesive is provided with a release layer removable by the user, upon which the tab is adhered to the container or, if activation is required (e.g., by solvent or heat), the adhesive can be activated and then the tab adhered. In a further embodiment, a smaller area 146 within the adhesive coated area 145 is coated only with a temporary adhesive effective to adhere the tab to a substrate (e.g., the outside of the tube, such as one of surfaces 127 or 129) and allow its removal and application to the seam of the tube; the release layer includes an opening associated with the temporary adhesive area.

Figure 6A:
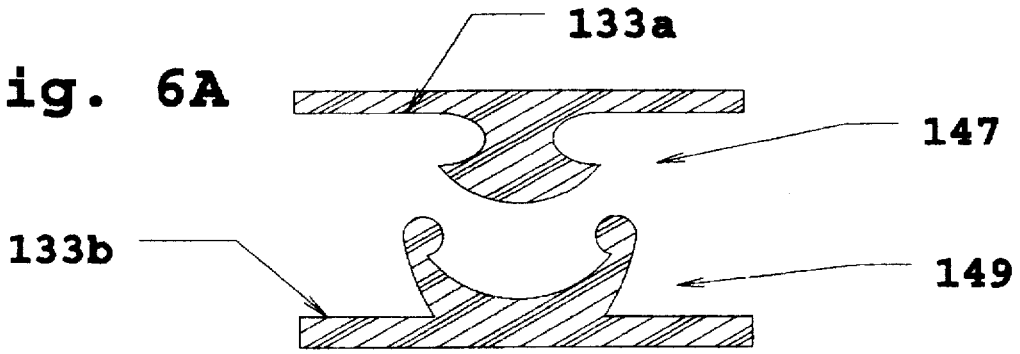
FIGS. 6A, 6B, and 6C depict a cross-section and two perspective views, respectively, of additional embodiments of securing means according to this invention.
Figure 6B:
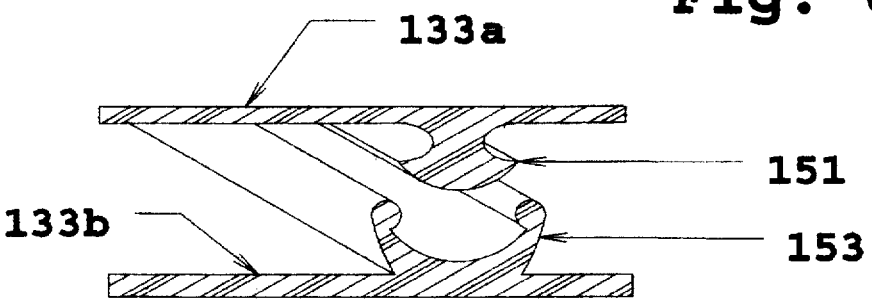
Figure 6C:
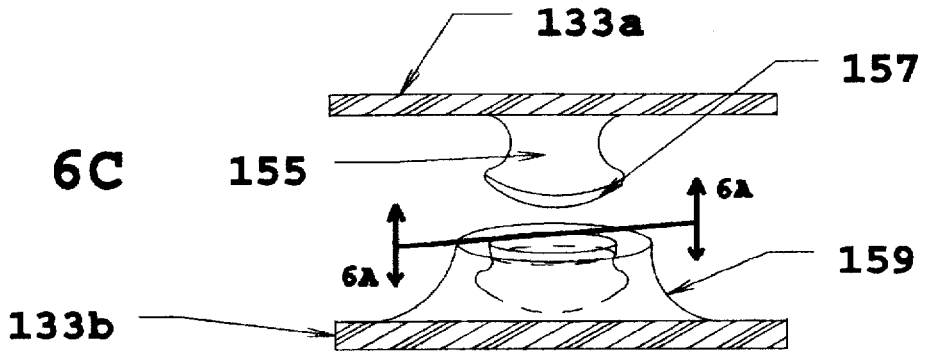

The ability to form a one or more essentially effective seams closer to the dispensing end clearly facilitates use of the container as the contents are extruded. Other types of mechanical fasteners are shown in FIGS. 6A–6C. In the cross-section in FIG. 6A, one of the tab surfaces has a hub 147 adapted to engage a receptacle 149 on the tab surface, optionally in a releasable manner. The securing means shown in FIG. 6B includes a hub bar 151 which is adapted to cooperate with a receptacle in the geometry of a track 153. In another alternative shown in FIG. 6C, the nub can be a unitary shaft 155 having an enlarged terminus 157 adapted to engage a socket 159 attached to the cooperating surface of the tab and be retained therein by frictional engagement (typically due to the socket having an opening smaller than the enlarged terminus of the shaft). The means shown in the embodiment in FIG. 6B is conventionally used in various embodiments in consumer food packaging as "locking"-type (polyethylene) storage bag devices.

Figure 7A:
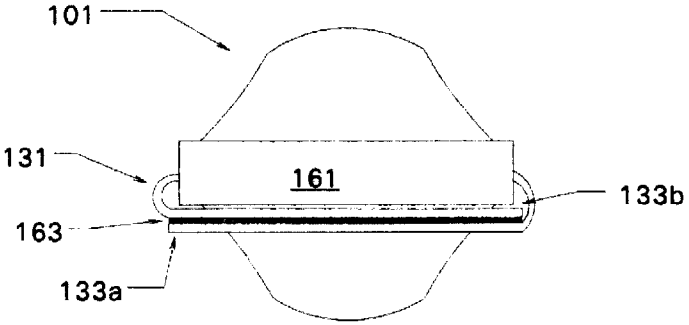
FIGS. 7A and 7B depict, respectively, a rear view and a rear perspective view of a squeezable tubular container of this invention secured in an at least partially rolled up geometry.
Figure 7B:
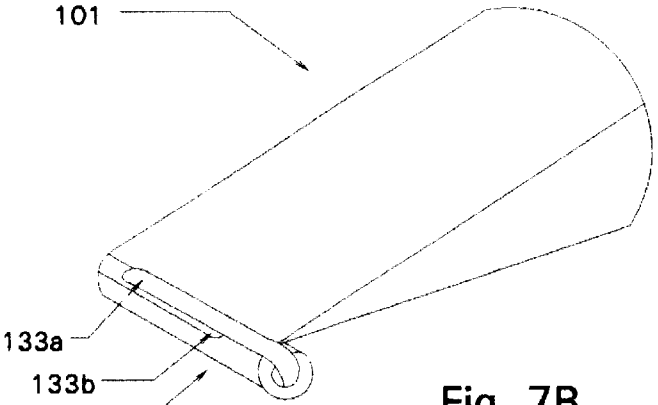

In operation, as shown in the rear view of FIG. 7A, the opposing ends **133*a* and 133*b* of the tab 131 are wrapped around a rolled-up portion 161 of the tube (reference is also made to FIG. 1). The opposing ends of the tab are shown mechanically engaged in area 163**, such as the integral structure formed when hook and loop mechanical fasteners are engaged. A perspective view is shown in FIG. 7B. The tube is used as usual, and when sufficient material has been squeezed out, the opposing ends of the tab are disengaged, the tube is rolled up further, and the ends of the tabs are re-engaged in overlapping arrangement.

Figure 8A:
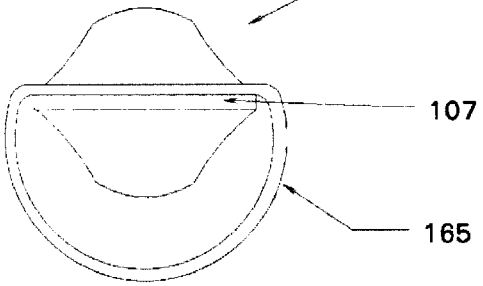
FIGS. 8A and 8B depict, respectively, rear views of another embodiment of the tab securing means of this invention on a squeezable tubular container prior to being rolled and after being partially rolled up and secured according to this invention.
Figure 8B:
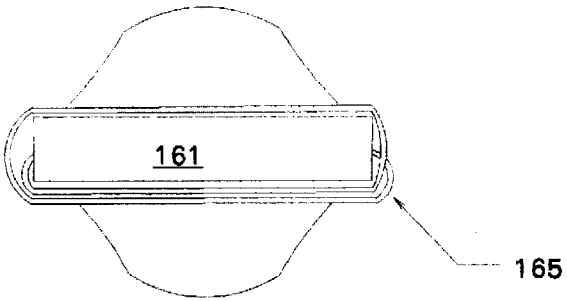

In another embodiment, the tab can be an elastic band 165 (e.g., a rubber band) attached to the seam, as shown from the rear view in FIG. 8A. When a portion of the tube is rolled up, the elastic is stretched and twisted into an overlapping relationship with itself as shown in FIG. 8B. It preferred that the elastic tab have a flat surface, as with the tab embodiments previously described, for attachment to the seam. Advantageously, because of the flexibility of elastic bands, twisting of the band caused by rolling up the tube can be avoided because the band, adhered along the linear surface of the container seam, can always be straightened out to depend as shown in FIG. 8A before between stretched and twisted into place as shown in FIG. 8B. It should be noted that FIG. 8B is an idealized view, and that the elastic tab will be twisted when in the configuration shown; the band need not be more twisted as it is released, the tube rolled up further, and the elastic be again twisted and positioned to mechanically engage the rolled up portion of the container.

Figure 9A:
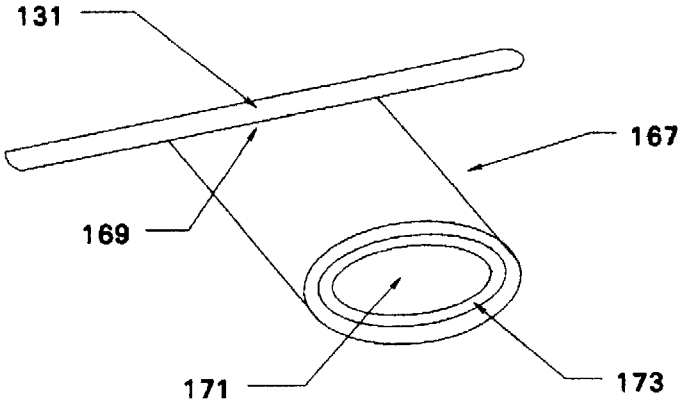
FIGS. 9A, 9B, and 9C depict perspective views of a sleeve according to this invention for housing a squeezable tubular container and maintain the housed container in an at least partially rolled up geometry.
Figure 9B:
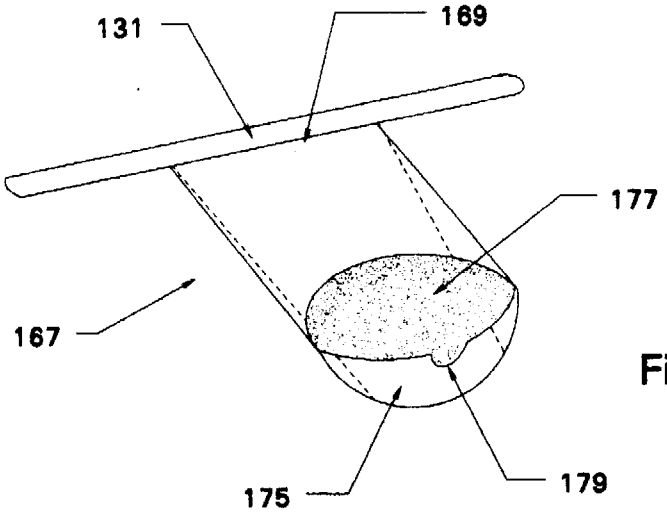
Figure 9C:
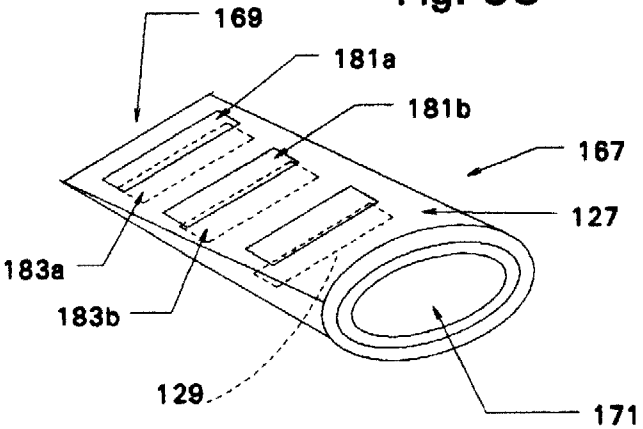

Instead of having the tab securing means formed integrally with the container, the securing means can be provided in the form of a reusable sleeve as shown in FIGS. 9A–9C. The sleeve 167 includes tab securing means 131 and is generally in the same geometry as the conventional dispensing tube with a sealed end 169, but lacking any covering dispenser at the open end 171; the open end is adapted to receive a conventional squeezable dispensing tubular container. In operation, the dispensing tube is inserted into the sleeve and used in the usual manner the sleeve with the container inserted therein is rolled up and secured in that configuration by the securing means on the sleeve. In a preferred embodiment, the sleeve is constructed of an outer layer which is washable and/or to which the securing means can be easily affixed, and an inner layer 173 of a material that enhances friction between the outer surface of the tubular container and the sleeve to facilitate retaining the container within the sleeve; examples of such materials include rubber and polymeric compositions having amounts of elastomers effective to increase the friction between the container and the sleeve. This embodiment of the invention in the form of a reusable sleeve provides the further advantage and fulfills the object of enabling end users to use the present invention with existing containers and those made by manufacturers which lack any such securing means.

FIG. 9B depicts another embodiment of a reusable sleeve, in which the sleeve 167, provided with tab securing means 131, has a front cover 175 opposite the sealed end 169. A portion of the tubular housing of the sleeve is provided with a pocket 177 adapted for receiving a squeeze tube slid into the sleeve (as a foot is slid into a slipper). The front cover is provided with a recess 179 adapted to receive and/or align the spout of the squeeze tube. When the tube is slid into the sleeve, the front cover acts to retain the tube in the sleeve. In the embodiment shown in FIG. 9C, the sleeve 167 having a sealed end 169 and an open end 171, and having first and second surfaces 127 and 129, analogous to those described previously, is provided with a series of mechanical fasteners **181*a* and 181*b* on the first surface and associated cooperating fasteners 183*a* and 183*b*** on the second surface. In operation, as the sleeve with the squeezable tubular container therein is rolled up, associated fasteners on each of the first and second surfaces align and engage each other.

The present invention has been described with reference to the foregoing embodiments and examples without being limited by the particular content thereof, and various additions, substitutions, deletions, and other modifications thereof are intended to be within the scope and spirit of the invention as defined by the following claims.

What is claimed is:

1. A dispensing container, comprising:

a) a tubular housing having a sealed end, a dispensing end, an outer surface, and an inner volume, the housing adapted for extrusion of a material therein by squeezing and adapted to be rolled up at least partially; and b) essentially inelastic tab means, attached to the outer surface and extending therefrom and effective to traverse the same, comprising at least one substrate, each substrate having a first end attached to the outer surface and a second free end and said substrate having an extent between said first and second ends effective to, when wrapped transversely around said housing, to overlap itself if a single substrate or, if more than one substrate, to overlap a second substrate, and attached to each said substrates a mechanically engagable fastener for securing at said overlap said substrate to itself or to a second substrate and thereby securing the housing in an at least partially rolled up geometry and effective when said fastener is fastened to resist the force of a material contained in the container when forced towards the at least partially rolled up portion of the tube from unrolling that portion of the tube when the container is squeezed.

2. The container of claim 1, wherein said securing means comprises first and second mechanically engagable fasteners.

3. The container of claim 2, wherein said mechanically engagable fasteners comprise hook and loop fasteners.

4. The container of claim 1, further comprising an extrudable material in said inner volume.

5. The container of claim 4, wherein said material is selected from the group consisting of sealing compounds, lubricants, toiletries, cosmetics, pharmaceuticals, and foodstuffs.

6. A reusable sleeve, consisting essentially of:

a squeezable tubular housing having an outer surface, a sealed end, and an open end, said open end adapted to receive into an interior of the housing a filled squeezable tubular dispensing container adapted for extrusion of a material therein by squeezing;

means for releasably retaining the container in the housing; and essentially inelastic means on said outer surface comprising a mechanically engagable fastener for securing said housing and the container received therein in an at least partially rolled up geometry and effective when engaged to resist the force of a material contained in the container when forced towards the at least partially rolled up portion of the tube when the container is squeezed while received in the sleeve.

7. The sleeve of claim 6, wherein said securing means comprises first and second mechanically engagable fasteners.

8. The sleeve of claim 7 wherein said mechanically engagable fasteners comprise hook and loop fasteners.

9. The sleeve of claim 6, further comprising said container and wherein the material in said container is selected from the group consisting of sealing compounds, lubricants, toiletries, cosmetics, pharmaceuticals, and foodstuffs.

10. The sleeve of claim 6, wherein the means for securing the housing comprises tab means attached to the outer surface and extending therefrom and effective to traverse the same.

11. A device for releasably maintaining a squeezable dispensing tubular container in an at least partially rolled up geometry, consisting essentially of:

an essentially inelastic tab strip having opposing ends and opposing sides; means attached to said opposing sides for releasably mechanically engaging said opposing ends to each other when said opposing ends are disposed in overlapping relationship; and adhesive coated onto one of said opposing sides for adhering said tab strip to said container; said tab strip having an extent between said ends effective to traverse said container and to allow said ends to overlap and mechanically engage each other.

12. The device of claim 11, wherein mechanically engaging means comprises cooperating hook and loop fasteners.

13. A device for releasably maintaining a squeezable dispensing tubular container in an at least partially rolled up geometry, consisting essentially of:

an essentially inelastic tab strip having opposing ends and opposing sides; means attached to said opposing sides for releasably mechanically engaging said opposing ends to each other when said opposing ends are disposed in overlapping relationship; and adhesive coated onto one of said opposing sides for adhering said tab strip to said container; said tab strip having an extent between said ends effective to traverse said container and to allow said ends to overlap and mechanically engage each other and a release layer disposed over said adhesive coating.

14. A device for releasably maintaining a squeezable dispensing tubular container in an at least partially rolled up geometry, consisting essentially of:

an essentially inelastic tab strip having opposing ends and opposing sides; means, attached to said opposing sides for releasably mechanically engaging said opposing ends to each other when said opposing ends are disposed in overlapping relationship; and adhesive coated onto one of said opposing sides for adhering said tab strip to said container; said tab strip having an extent between said ends effective to traverse said container and to allow said ends to overlap and mechanically engage each other and adhered to a squeezable tubular dispensing container by said adhesive.

15. The device of claim 14, wherein said squeezable tubular dispensing container comprises a material selected from the group consisting of sealing compounds, lubricants, toiletries, cosmetics, pharmaceuticals, and foodstuffs.

* * * * *